United States Patent [19]

Morin

[11] 4,168,792

[45] Sep. 25, 1979

[54] NEEDLE FOR TATTING

[76] Inventor: Edward A. Morin, 4835 SW. Oleson Rd., Portland, Oreg. 97225

[21] Appl. No.: 909,827

[22] Filed: May 26, 1978

[51] Int. Cl.[2].....D05B 85/00; D04G 5/00; D04C 7/00

[52] U.S. Cl. ..... 223/102; 87/52

[58] Field of Search.....223/102; 87/52, 58
87/52, 58

[56] References Cited

U.S. PATENT DOCUMENTS

| | | | |
|---|---|---|---|
| 1,490,176 | 4/1924 | Mason et al. | 87/52 X |
| 2,706,071 | 4/1955 | Garuie | 223/102 |
| 2,715,486 | 8/1955 | Moghadam et al. | 223/102 |

*Primary Examiner*—Louis Rimrodt
*Attorney, Agent, or Firm*—James D. Givnan, Jr.

[57] ABSTRACT

A needle is disclosed for the making of lace by the method known as tatting, which needle has an end segment with inwardly converging side surfaces converging toward the needle end with an eye extending therebetween. The side surfaces are shaped to facilitate transfer of a series of knots formed on the needle shaft to a doubled carrying cord passed through the needle eye.

3 Claims, 6 Drawing Figures

NEEDLE FOR TATTING

BACKGROUND OF THE INVENTION

The present invention concerns needle construction for use in the formation of decorative handmade lace known as tatting which heretofore has been accomplished with a small hand held shuttle.

The present needle construction enables tatting of doilies, edgings, trims and daisies at a more rapid pace without the use of a shuttle and without the dexterity required for shuttle use.

The shuttle heretofore used in the formation of tatting requires thread or yarn to be wound thereon periodically. Considerable time is saved by use of the present needle which utilizes thread, or yarn, directly from a spool or ball.

The existing practice of using a shuttle requires considerable experience before tatting may be produced at a rapid rate.

SUMMARY OF THE PRESENT INVENTION

The present invention is embodied within a needle manually held during tatting having at least one end segment having oppositely disposed concave wall surfaces against which cord segments may be positioned to permit sliding removal of tatting loops or knots onto the carying cord of thread, yarn, etc. Accordingly, the shuttle and its drawbacks as above mentioned are dispensed with. With the present needle rings, scallops, picos may all be formed much more expeditiously than heretofore possible.

The present needle has at least one end segment configured in a somewhat pointed manner with lengthwise directed recessed side areas formed on said segment end with a needle eye extending therebetween. The side areas of the needle permit tatting loops, formed on the needle, to be slid past the needle end onto a four strand carrying cord threaded through the needle eye.

Important objectives of the present tatting needle include the provision of a needle on which tatting loops are formed by needle and yarn (thread) manipulation without requiring a shuttle; the provision of a tatting needle having one end segment formed with converging surfaces and an eye within which a doubled segment of the carrying cord is positioned enabling convenient and rapid transfer of tatting loops to the cord; the provision of a tatting needle with oppositely disposed converging concave walls at one end of the needle within which yarn thread or the like, constituting the carrying cord, is positioned during tatting knot transfer.

DETAILED DESCRIPTION OF THE PREFERRED EMBODIMENT

Figure 1:
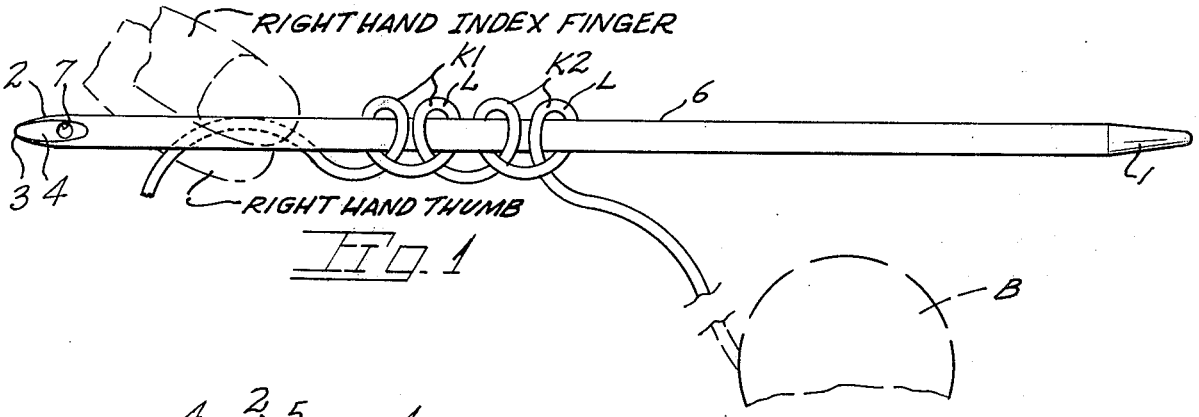
FIG. 1 is a side elevational view of the present needle.

With continuing reference to the drawing, the reference numeral 1 indicates one end of the cylindrical body or shaft of the present needle which, in one embodiment for use with yarn, may be a number three needle and have a diameter of approximately 2.38 mm and be approximately twenty cm in length.

Figure 2:
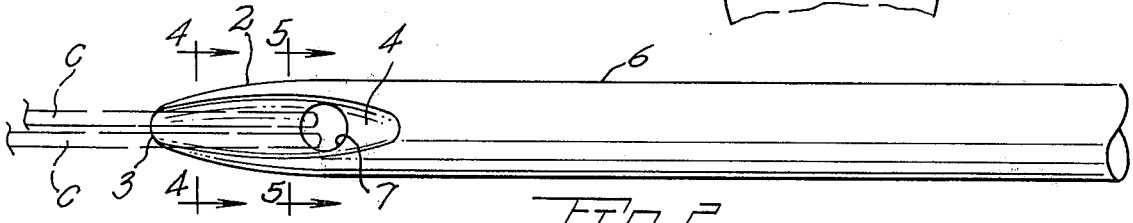
FIG. 2 is a side elevational view of the right hand end segment of FIG. 1 on an enlarged scale.

An end segment of the needle is indicated at 2 which terminates in a blunt rounded end 3 as viewed in the side elevational view of FIG. 2. The end segment 2 of the needle defines oppositely disposed concave wall surfaces 4 and 5 which converge endwise and which merge with a cylindrical center portion 6 of the needle. An eye 7 extends transversely of the needle end intermediate concave wall surfaces 4 and 5. Said eye while shown in circular may be elongate to facilitate threading of the four strand carrying cord C (yarn, thread, etc.,) therethrough.

Wall surfaces 4 and 5 are concave to receive the four strands of carrying cord C to facilitate knot transfer over the cord segments so disposed.

In tatting, the tatting needle is threaded with a doubled piece of thread or yarn, termed the carrying cord at C and preferably about two yards in doubled length. The doubled end of the carrying cord is inserted through eye 7 and pulled through the eye leaving only two or three inches of free ends. The threaded needle is then grasped in the right hand.

Figure 3:
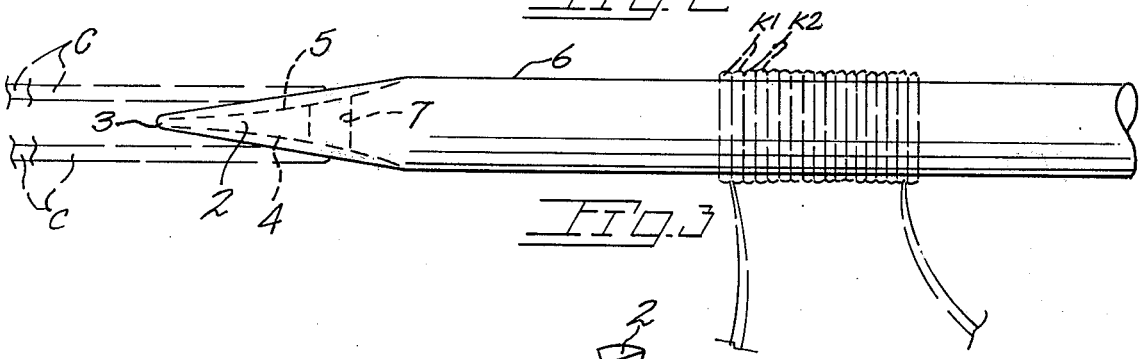
FIG. 3 is a plan view of FIG. 2.
Figure 4:
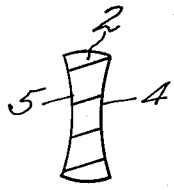
FIGS. 4 and 5 are enlarged sectional views taken along lines 4—4 and 5—5 of FIG. 2, respectively.
Figure 5:
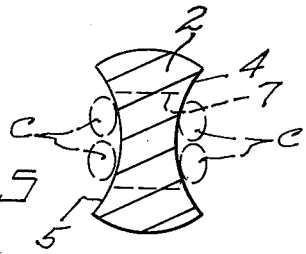
Figure 6:
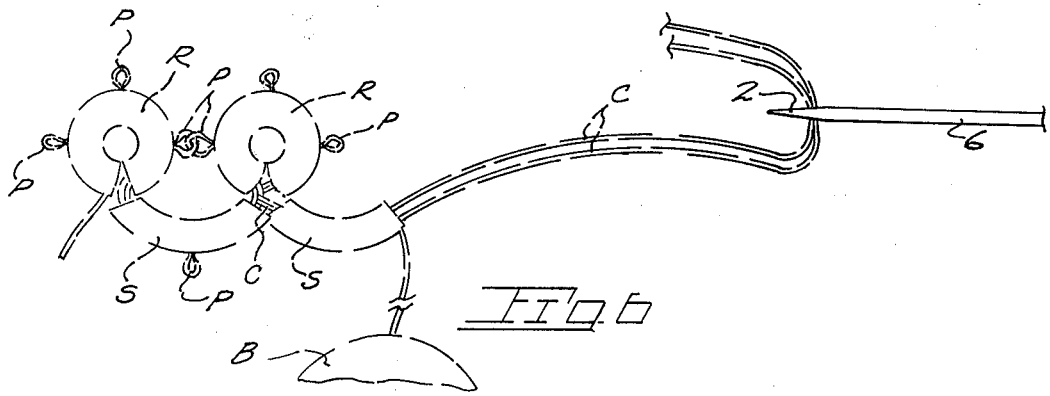
FIG. 6 is a diagrammatic view of a partially completed workpiece.

All double stitches or knots at K1 and K2 are looped over the front end 1 of the needle from the ball B of yarn or thread. The end of the yarn or thread from the ball is taken with the remaining hand and placed under the right thumb to secure it against the needle. With the left hand a loop is made with the yarn or thread as though you were writing a small letter "e" . Put it on from the front end 1 of the needle. Pull the yarn or thread to tighten the loop against the right thumb on the needle. Loose loops are shown in FIG. 1 which in actuality are snugged as made against one another after formation per FIG. 3.

The remaining or second loop of the knot is made in a special way. With the right hand, while holding the needle, make a loop as though you were writing a small letter "e" backwards. Put it on the needle next to the last loop. Pull the yarn or thread to tighten it. This makes a tatted knot.

Another way to make a tatted knot is somewhat faster. Pick up the yarn or thread with the left hand and place the end of it under the right thumb and hold it against the needle as before. Pick up the yarn or thread with the left hand and wrap it around the left thumb clockwise. Insert the front end 1 of the needle into this loop along the outside edge of the thumb. Pull the yarn or thread with the left hand to tighten the loop on the needle. This completes the first half or loop L of the knot.

Secondly, pick up the yarn or thread with the left hand again and wrap it around the thumb in a counterclockwise direction. Insert the front end of the needle into this loop along the inside edge of the thumb. Pull the yarn with the left hand to tighten the loop. This completes the second and last loop of a tatting knot. Make the desired number of knots as at K1 and K2, say 16 or so, on the needle shaft and upon completion thereof, slide all of the knots off the opposite needle end 2 onto carrying cord C within three inches from the end of the cord or previous work completed on the cord, then end 1 of the needle is inserted between the doubled carrying cord just before the first formed knot K1 of the ring just formed and then pulling the needle and attached carrying cord through causes the ends of the knot series to be pulled together to form the series of knots into a circle termed a tatting ring at R.

To continue tatting, reverse the work by turning the ring over to the right. Place the finished ring against the needle under the right thumb. Make about eight knots or so and then also slide them onto carrying cord C until they come into position next to the ring. A semi-circle shape is so formed because as they are not drawn together as was the ring. This last described series of knots is called a tatting scallop at S.

To make another attached ring, reverse the completed work and begin by placing the needle on top of the last knot. Repeat the instructions for the first ring.

Picots at P are small loops that stand out from the edges of the tatting. They are decorative and make the tatting lace-like. Various designs and patterns may be made by using these loops to connect rings and scallops. After completion of one of a series of tatting knots, a picot may be formed by placing the end of the right index finger over the space on the needle next to the last knot and holding it there until you have completed making the next knot, spaced a distance along the needle from the preceding knot. Remove the finger and then slide the knots together with the intervening yarn forming the picot. A larger picot is made by placing your index finger plus one or two more fingers on the needle as a gauge and holding same in place until the next knot is completed. Larger picots are also used when beads are to be worked into tatting. A picot only refers to the loop and does not count as a knot or stitch.

To join rings by their picots hold the previous ring in the left hand. Use the right hand to catch the yarn or thread of the picot of a second ring being formed with the tip of the tatting needle and draw it through the last picot of the previous ring. Place the loop back on the needle and continue to for the series of knots making up the tatting ring.

To make a correction in needle tatting, unthread the needle and insert the tip of the tatting needle between the two knots made before the error occurred and pull out the carrying cord. Rethread the needle and resume tatting.

While I have shown but one embodiment of the invention it will be apparent to those skilled in the art that the invention may be embodied still otherwise without departing from the spirit and scope of the invention.

Having thus described the invention, what is desired to be secured under a Letters Patent is:

1. A needle for use in tatting and threadable with a four strand segment of a carrying cord, said needle comprising, a shaft of cylindrical configuration on which tatting knots may be formed, an end segment of said shaft being of tapered configuration and having a pair of endwise converging walls, each of said walls being concave in section, a needle eye in said end segment and extending between said walls, said needle eye being of a size to substantially fully occupy a segment of the wall surfaces, said needle shaft adapted to have a series of juxtaposed tatting knots formed thereon for subsequent sliding transfer onto the carrying cord, and said walls by reason of their concavity partially defining areas on opposite sides of the needle end segment within which two strands each of the carrying cord may be momentarily recessed to enable unobstructed transfer of the series of knots over the recessed strands and onto the cord.

2. The needle claimed in claim 1 wherein said end segment terminates in a blunt point.

3. The needle claimed in claim 1 wherein the remaining end segment of the needle shaft is of tapered configuration.

* * * * *